United States Patent [19]

Ducroquet et al.

[11] 4,282,500

[45] Aug. 4, 1981

[54] GROUND FAULT CIRCUIT INTERRUPTING DEVICE

[75] Inventors: Jean-Louis Ducroquet, Eybens; Michel Lazareth, Grenoble, both of France

[73] Assignee: Merlin Gerin, Grenoble, France

[21] Appl. No.: 51,388

[22] Filed: Jun. 25, 1979

[30] Foreign Application Priority Data

Jul. 3, 1978 [FR] France ..... 78 20135

[51] Int. Cl.[3] ..... H01H 83/02

[52] U.S. Cl. ..... 335/18; 361/45

[58] Field of Search ..... 335/18; 200/160, 51 R; 361/44, 45, 115, 331, 336, 357, 360

[56] References Cited

U.S. PATENT DOCUMENTS

| | | | |
|---|---|---|---|
| 510,540 | 12/1893 | Hunter | 200/160 |
| 3,388,229 | 6/1968 | Lyvang | 200/249 |
| 3,922,586 | 11/1975 | Buxton et al. | 335/18 |
| 4,000,444 | 12/1976 | Douglas et al. | 335/18 |

FOREIGN PATENT DOCUMENTS

| | | |
|---|---|---|
| 1020404 | 5/1958 | Fed. Rep. of Germany . |
| 876426 | 5/1963 | Fed. Rep. of Germany . |
| 2005605 | 12/1969 | France . |
| 2125425 | 9/1972 | France . |
| 2375740 | 6/1978 | France . |

*Primary Examiner*—Harold Broome

*Attorney, Agent, or Firm*—Stevens, Davis, Miller & Mosher

[57] ABSTRACT

A ground fault circuit interruption device including a standard molding case circuit breaker and a molded case ground fault detector module mounted in side-by-side relationship. The ground fault detector module includes a push button test switch which is open in the uppermost and in the lowermost positions. Flexible conductors extend through openings provided in the wall of the ground fault detector module and are connected to the line terminals of the circuit breaker. A reset push button is positively latched in the reset position.

2 Claims, 10 Drawing Figures

GROUND FAULT CIRCUIT INTERRUPTING DEVICE

This invention relates to a ground fault interrupter device comprising a standard circuit breaker module and a ground fault detector module mounted in side-by-side relationship and secured together by screws. The molded insulating housings for the circuit breaker and for the ground fault detector have the same general dimensions so that the combined unit may be mounted in conventional panelboards.

A ground fault detecting unit or module basically includes a differential current transformer to detect current imbalance in the load energizing lines and an electromagnetic operator energized by the current transformer for releasing latch means normally maintaining an operating mechanism in a latched position against forces exerted by a spring. The released operating mechanism actuates a tie bar extending into the circuit breaker housing for automatic tripping of the circuit breaker.

It is accordingly an object of the present invention to provide a simplified ground fault detection device combined with standard molded case circuit breakers.

Another object is to provide a construction for the ground fault operating mechanism of small width and able to withstand to shocks.

Another object is to provide a novel test switch for a ground fault circuit protector.

Still another object is to provide electrical connection between the circuit breaker module and the ground fault detector module which may be effected by every one.

These objects as well as other objects of this invention will become readily apparent upon reading the following description of the accompanying drawings, in which.

Figure 1:
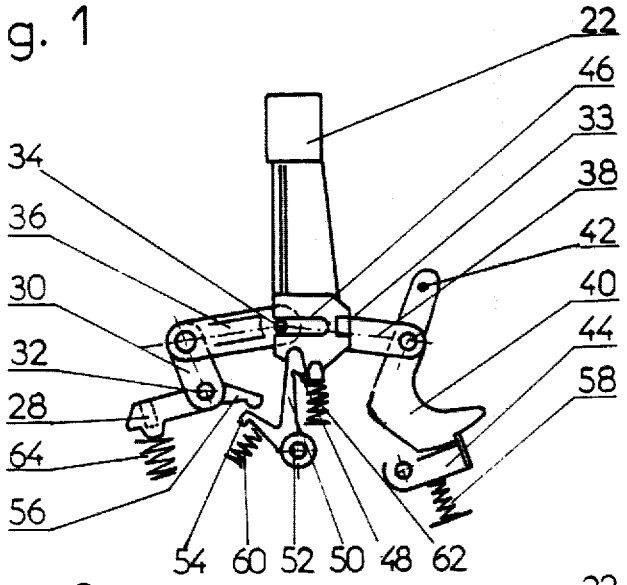
FIGS. 1, 2 and 3 are diagrammatic side elevations showing the operating mechanism of the ground fault detector respectively in the latched position, in the just unlatched position and in the released position.

Ground fault detector module 10 has a molded housing connected side-by-side 12 to the housing of a molded case circuit breaker 14 of the same shape to provide a combined unit which can be mounted in conventional panelboards. A manual operating handle 18 extends from the forward end 16 of the circuit breaker 14 and two depressible buttons 20, 22 for operation of a test switch and for hand-reset of an operating mechanism extend from the forward end 16 of the detector module 10.

Figure 8:
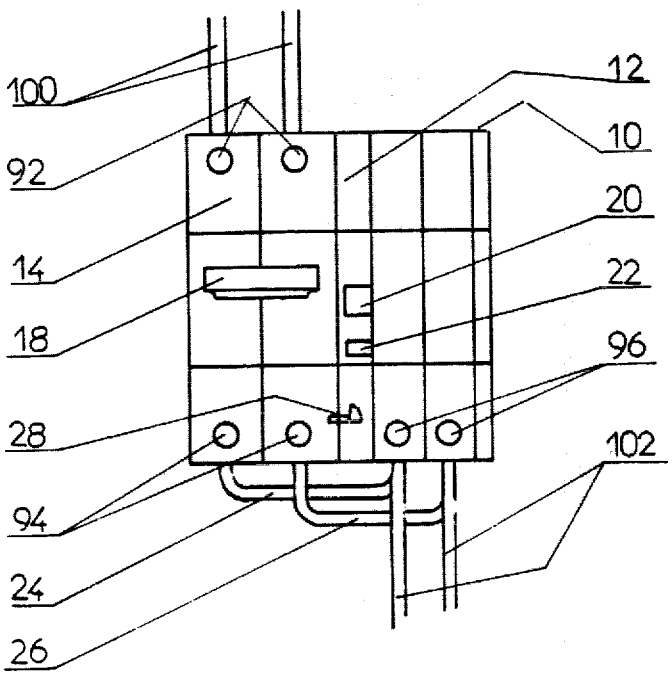
FIG. 8 is a plan view of the combined unit constituted by assembly of a detector module and a circuit breaker module.
Figure 9:
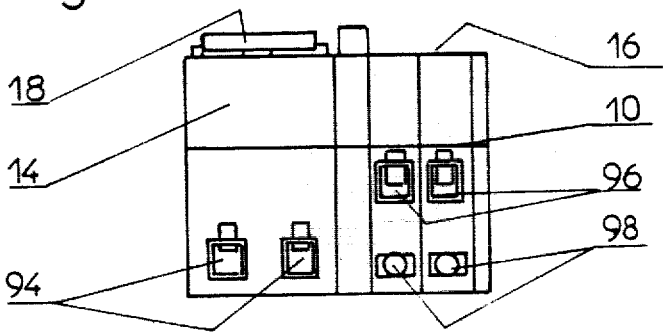
FIG. 9 is an end view of the combined unit.

As seen in FIGS. 8 and 9, the two-pole circuit breaker 14 is electrically connected to the ground fault detector module 10 by flexible conductors or leads 24, 26 and a finger 28 passes through a bore in the side walls 12 to actuate the tripping device of the circuit breaker 14 upon the occurrence of a ground fault.

Figure 2:
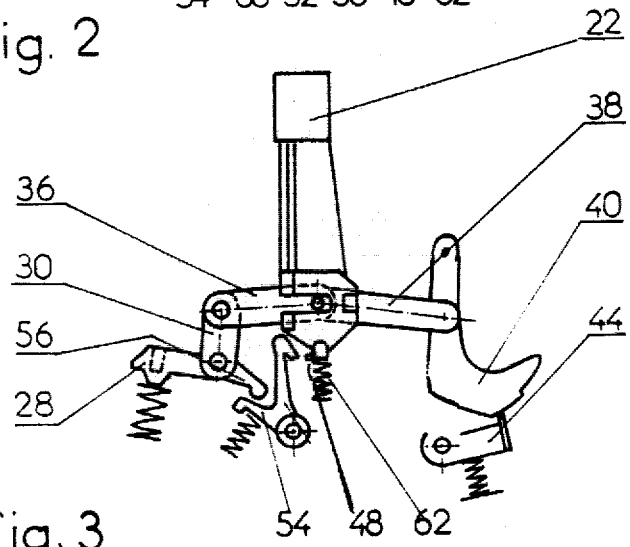
Figure 3:
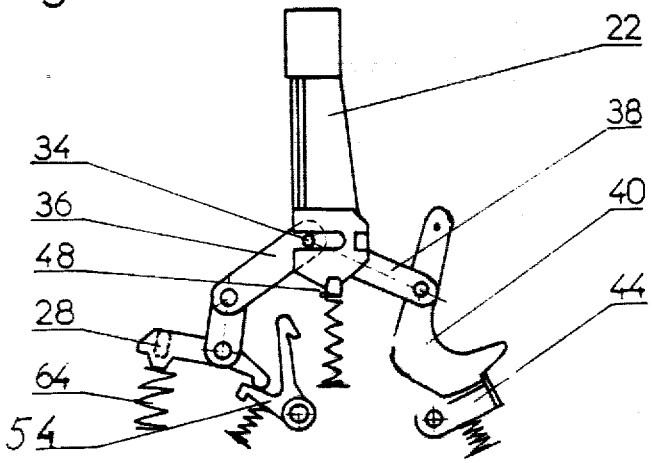
Figure 10:
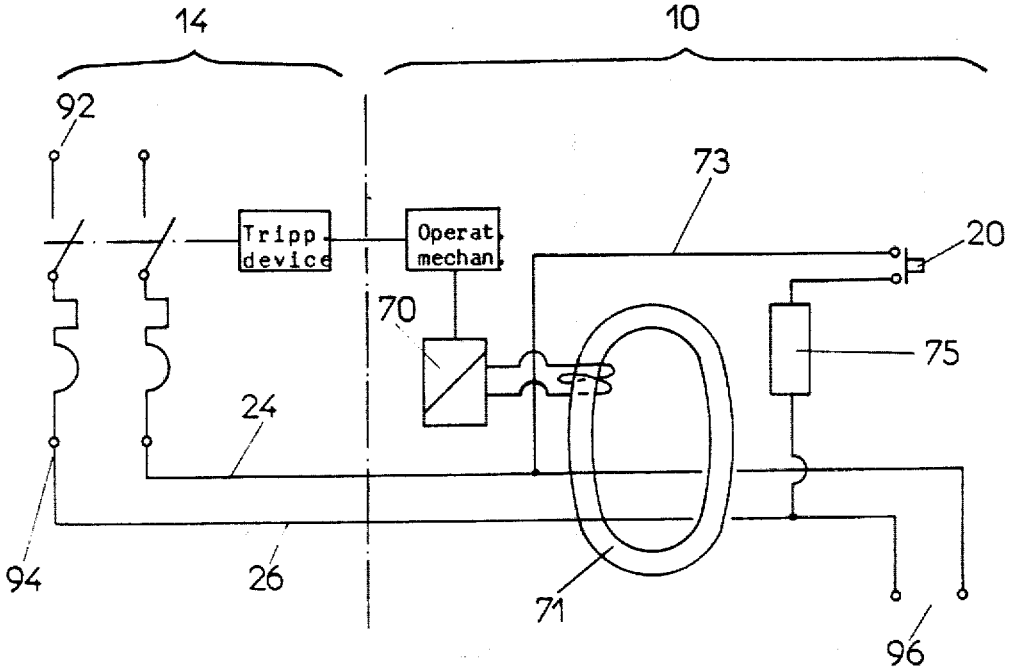
FIG. 10 is an electrical schematic of the ground fault circuit interrupting device.

As shown in FIGS. 1-3, finger 28 is formed on one arm of a rocker 30 pivoted at housing pin 32. The other arm of rocker 30 is articulated to one end of a toggle link 36 having its other end connected by toggle pin 34 to the other toggle member 38. The toggle mechanism 33 formed by the links 36, 38 connects rocker 30 to latch 40 which is pivotally mounted on pin 42. The end of latch 40 is provided with a nose which is normally engaged by latching lever 44. The toggle pin 34 is slidably mounted in transversal groove 46 provided in reset push button 22. The latter is provided with a nose 48 which is engaged in the reset position by a locking lever 50. Locking lever 50 is pivotally mounted on pin 52 and has an extension 54 that is positioned for engagement by extension 56 of rocker 30. Latching lever 44 and locking lever 54 are biased by springs 58, 60 in the latched position and a spring 62 biases the reset button 22 in the upper released position. The rocker 30 is biased clockwise with respect to FIGS. 1-3 by spring 64 so that finger 28 engages the tripping device (not shown) of circuit breaker 14 when latching lever 44 is released. In the straight position of the toggle mechanism 33 shown in FIG. 1, the push button 22 is latched by the locking lever 50 and the toggle levers 36, 38 constitute a link between rocker 30 and latch 40. The toggle pin 34 is on the left side of the groove 46 and the latching lever 44 is actuated by an electromagnetic operator 70 energized by a differential current transformer 71 (FIG. 10).

In the event a ground fault appears, the net sum of the currents flowing through the leads 24, 26 passing through the differential current transformer 71 will not cancel one another so that the electromagnetic operator 70 is energized. The latching lever 44 rotates clockwise with respect of FIG. 1 and releases the latch 40. As the toggle 33 is moved transversely to the right (FIG. 2), the rocker 30 pivots clockwise by the action of spring 64 and finger 28 causes the tripping of circuit breaker 14 in a manner well known. At the same time rocker 30 actuates locking lever 50 and the released button 22 moves upward causing the toggle mechanism 33 to collapse and to replace the latch 40 for engagement by the latching lever 44 (FIG. 3).

To reset the ground fault detector module 10, button 22 is depressed to move toggle pin 34 to the extended position shown in FIG. 1. Spring 64 is compressed to store the tripping energy and the released locking lever 50 engages nose 48 to lock button 22 positively in the depressed reset position. The circuit breaker 14 may be closed by manual operation of handle 18.

The elements of this operating mechanism are secured to a metallic plate 69 which extends parallel to the side wall 12 of the housing.

Figure 7:
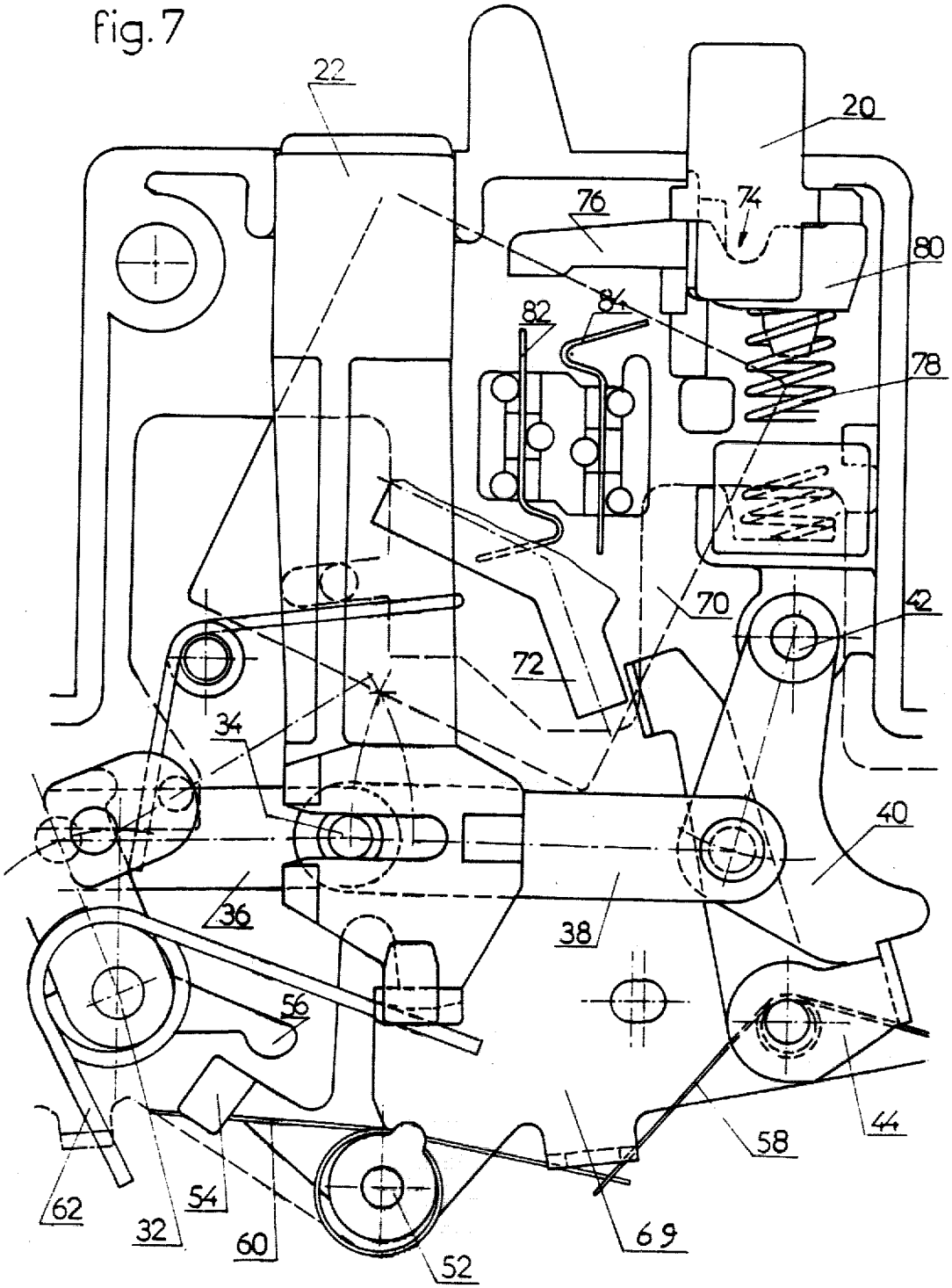
FIG. 7 is a side elevation of the detector module.

FIG. 7 shows a preferred embodiment of this invention, wherein like reference numerals refer to corresponding parts of the other figures.

Figure 4:
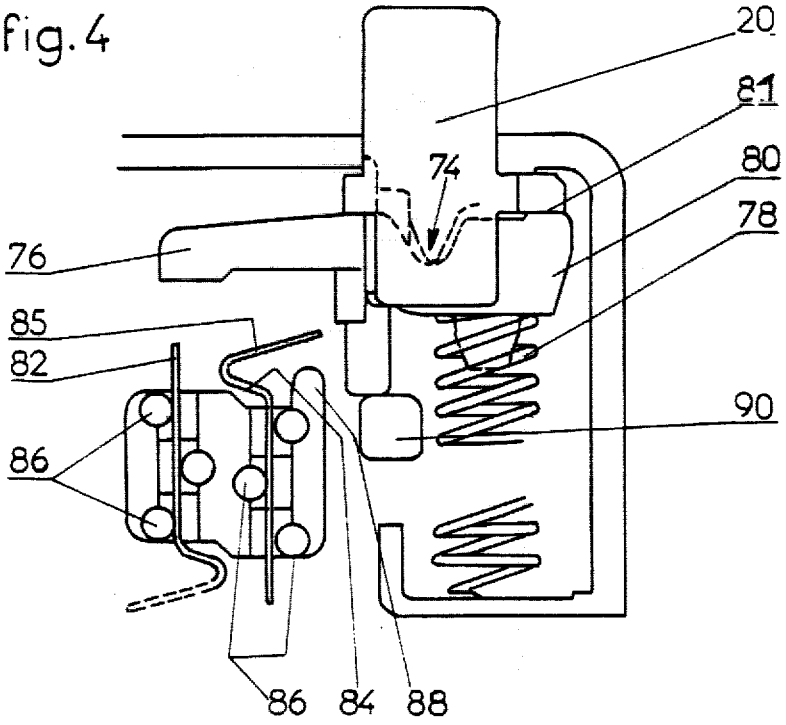
FIGS. 4, 5 and 6 are side elevations of a test switch in the open, closed and depressed positions.
Figure 5:
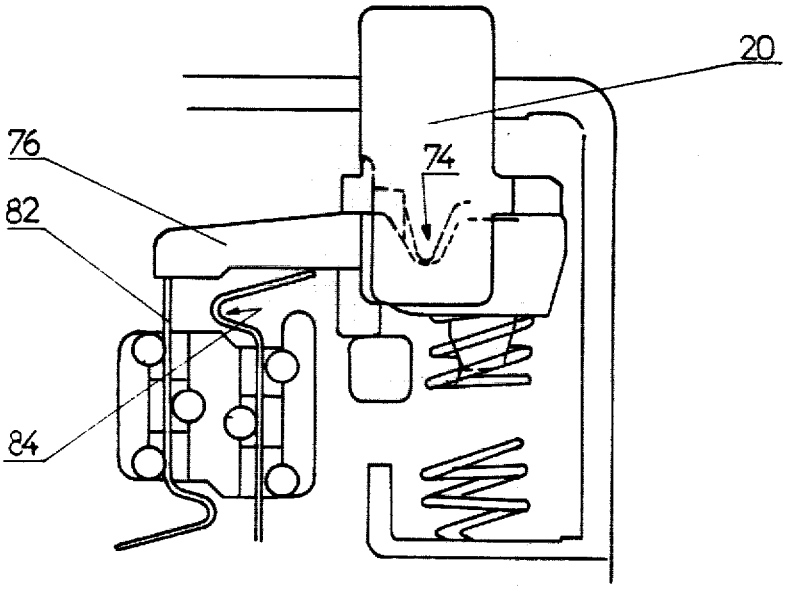
Figure 6:
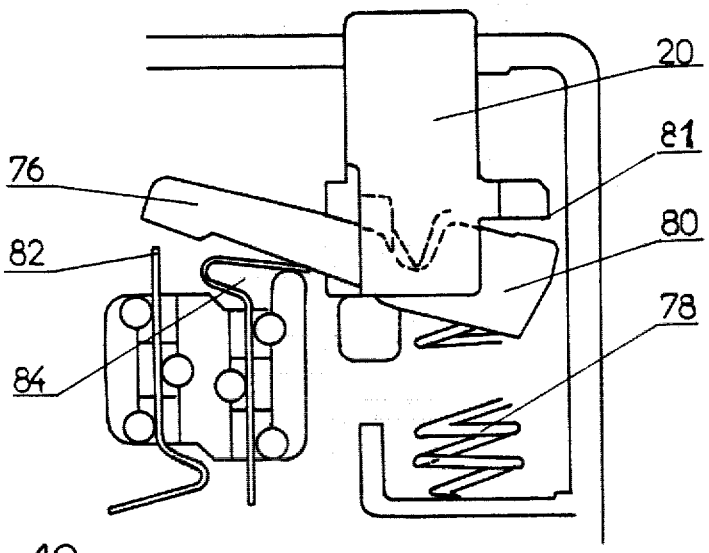

The armature 72 of electromagnetic operator 70 engages the latching lever 44 and a push button 20 is provided for operation of a test switch more particularly described thereafter with reference to FIGS. 4-6.

The ground fault detector module 10 includes a test circuit 73 connected between the leads 24, 26 and passing outside the core current transformer 71. The test circuit 73 includes a resistor 75 and a test switch having a movable contact bridge 76 cooperating with two contact blades 82, 84. Contact bridge 76 is pivotally mounted on axis 74 of push button 20 and an abutment 81 limits the counterclockwise rotation with respect of FIGS. 4-6. A spring 78 biases a projection 80 of contact bridge 76 in the abutted position wherein contact bridge 76 extends perpendicularly to the push button 20, the latter being biased in the uppermost position by spring 78. Contact blades 82, 84 are secured to the housing by pins 86 so that their upper ends face contact bridge 76. The upper end 85 of contact blade 84 is bended as leaf spring to deflect towards an abutment 88 when the test push button 20 is depressed and brings contact bridge 76 into engagement with contact blades 82, 84. An abutment 90 limits the depression of push button 20.

To summarize the operation of the test switch it is noted that under normal conditions the test circuit is open (FIG. 4). When the test push button 20 is depressed the contact bridge 76 is moved into engagement with both contact blades 82, 84 to close the test switch as shown in FIG. 5. When the push button 20 is further depressed the upper end 85 is deflected into engagement with abutment 88 and thereafter contact bridge 76 pivots clockwise and separates from contact blade 82 to open the test circuit. It is clear that the test circuit is closed only for a short time during the depression movement of push button 20 and that the test circuit is opened as well in the released as in the depressed position of push button 20. This prevents any overheating of resistor 75.

As seen in FIGS. 8 and 9, the reset and test push buttons 22, 20 and the operating handle 18 extend from the forward end of the ground fault circuit interrupting unit 10, 14. The circuit breaker module 10 includes terminals 92, 94 disposed in the usual manner along opposite sides of the circuit breaker housing. Detector module 10 includes terminals 96 disposed at the same side as terminals 94 of module 14 and openings 98 disposed under terminals 96. Disposed within the housing of the detector module is the core current transformer 71 through which single turn windings formed by leads or flexible conductors 24, 26 extend. One end of leads 24, 26 is connected by terminals 96 and the other end passes through the openings 98 and is connected to terminals 94 disposed at the same side. The latter connection is effected after assembly of the modules 10, 14. According to conventional practice the line and load conductors 100, 102 are connected to terminals 92, 96 disposed at opposite sides of the unit 10, 14.

It is clear that the circuit breaker module 14 and the ground fault detector module 10 may be saled separately. When it is desired to provide a ground fault protection, module 10 is added to the conventional circuit breaker 14.

What we claim is:

1. A ground fault circuit interruption device including a circuit breaker module and a ground fault detector module mounted in side-by-side relationship, said circuit breaker module comprising a manual operating handle and an automatic tripping device, said ground fault detector module comprising a differential current transformer, an electromagnetic operator energized by said current transformer and a spring powered operating mechanism including a toggle means formed by first and second links pivotally connected at a knee, a reset push button linked to said knee to reset said toggle means into a straight position, a latch means cooperating with said first link for maintaining said toggle means in an operating position, a rocker operatively connected to said second link and to said circuit breaker tripping device for opening said circuit breaker responsive to the releasing of said latch means, a latching means for maintaining said reset push button in a reset position and thereby said toggle means in the straight position, said rocker having means for releasing said latching means of said push button when said rocker actuates said tripping device.

2. A ground fault circuit interruption device as set forth in claim 1, said differential current transformer having a core and a pair of conductors passing through said core, for detecting a current imbalance in said conductors, further including a test circuit having a series connected resistor and test switch for causing a current imbalance in said conductors and an artificial ground fault by closing of said test switch, said test switch including a push button, a contact bridge semipivotally mounted on said push button and a pair of fixed contacts so located with respect to said contact bridge that in the uppermost position of said push button the contact bridge is separated from both fixed contacts, in an intermediate position the contact bridge is in contact with both fixed contacts to close the test switch and in the depressed position the pivoted contact bridge rests only on one of said fixed contacts, the test switch being open.

* * * * *